US007665190B2

(12) United States Patent
Weng

(10) Patent No.: US 7,665,190 B2
(45) Date of Patent: Feb. 23, 2010

(54) ADJUSTING DEVICE FOR A GOGGLE STRAP

(76) Inventor: Jin-Xian Weng, Qiao Li Administrative District, Chang Ping Town, Dong Guan City 523586, Guangdong (CN) 523586

( * ) Notice: Subject to any disclaimer, the term of this patent is extended or adjusted under 35 U.S.C. 154(b) by 221 days.

(21) Appl. No.: 11/874,638

(22) Filed: Oct. 18, 2007

(65) Prior Publication Data

US 2009/0100645 A1 Apr. 23, 2009

(51) Int. Cl.
*A44B 11/12* (2006.01)

(52) U.S. Cl. ..... 24/170; 2/426

(58) Field of Classification Search ..... 24/265 R, 24/170, 171, 194, 196, 614, 615, 629, 625; 2/426, 452, 448
See application file for complete search history.

(56) References Cited

U.S. PATENT DOCUMENTS 6,691,377 B2 * 2/2004 Pan ..... 24/170
6,961,965 B2 * 11/2005 Chiang ..... 2/445
7,100,215 B2 * 9/2006 Shiue ..... 2/443
7,162,778 B2 * 1/2007 Pan ..... 24/170
7,444,689 B2 * 11/2008 Chiang ..... 2/428
2006/0070215 A1 * 4/2006 Sung ..... 24/615
2009/0038062 A1 * 2/2009 Chiang ..... 2/445

* cited by examiner

*Primary Examiner*—Victor Batson
*Assistant Examiner*—Rowland D Do
(74) *Attorney, Agent, or Firm*—Banger Shia

(57) ABSTRACT

An adjusting device for a goggle strap is disposed at both ends of the strap for quick connection to two connecting ends of the goggle body. The adjusting device comprises a body, a locking shaft, a cover and two push buttons. The strap is rolled around the locking shaft. When the cover is closed, a protruding strip of the strap is engaged by an engaging rib of the cover. When pressing the push buttons passed through both sides of the body, the cover is opened outward, so as to adjust the length of the strap again.

6 Claims, 7 Drawing Sheets

ADJUSTING DEVICE FOR A GOGGLE STRAP

BACKGROUND OF THE INVENTION

1. Field of the Invention

The present invention relates to an adjusting device for a goggle strap, and more particularly to an adjusting device for a goggle strap which can quickly adjust the length of the strap by assembling the strap to a goggle body.

2. Description of the Prior Art

With the improvement of the quality of life, the demand for recreational sports is increasing, and in addition to the general water sports, diving is also popular. By such sports, people can observe the eco-activity of the biology and enjoy the underwater beauty. However, people cannot stay in the water for a long time due to their physical structures, so other auxiliary diving equipments, such as goggle, diving suits, and air tank are required. The goggle is used to prevent the wearer's eyes from the seawater and causing discomfort and infection. And a well designed goggle provides the wearer with enhanced peripheral vision. In addition to preventing the leakage of seawater, a well designed goggle should also allow the wearer to wear and to adjust quickly and easily.

Referring to FIG. 1, a conventional adjusting structure 10 for a goggle strap is shown, which comprises a clamping seat 101, a clamping piece 102 and a spring 103. The clamping seat 101 is disposed at both ends of the frame of the goggle, and the clamping piece 102 is pivotally disposed in the clamping seat 101. The spring 103 is biased between the clamping seat 101 and a rear end of the clamping piece 102, such that when the rear end of the clamping piece 102 is pushed upward, a plate 1021 at a front end of the clamping piece 102 will move downward to engage between the adjacent two protruding strips 201 of the strap 20 by the elasticity of the spring 103, so as to fix the strap 20. By such arrangements, the user can press the rear end of the clamping piece 102 by one hand, and pull the strap 20 to adjust its length by the other hand according to his/her head circumference. However, since the strap 20 of the above-mentioned structure is fixed by the engagement of the plate 1021 of the clamping piece 102 and the protruding strips 201, and the distance formed between each two protruding strips 201 of the strap 20 defines a mode of multi-step adjustment, naturally, it will cause inconvenience. For example, if the strap 20 is adjusted too loose, the strap 20 is likely to loose or to cause leakage when underwater pressure is too great. And if the strap 20 is adjusted too tight, the user may feel uncomfortable, and even dizzy after a long time of wearing due to the pressure on the user's ears.

The present invention has arisen to mitigate and/or obviate the afore-described disadvantages.

SUMMARY OF THE INVENTION

The primary objective of the present invention is to provide an adjusting device for a goggle strap which not only can adjust the length of the strap quickly, but also can be assembled to the goggle body easily.

To achieve the objective of the present invention, the adjusting device is disposed at both ends of the strap for quick connection to two connecting ends of the goggle body. The adjusting device comprises a body, a locking shaft, a cover and two push buttons. The body is formed with a connecting end for assembling to one of the connecting ends of the goggle body. A containing space is formed in the body, and each side of the body is defined with a pivotal hole, a key hole and a shaft hole. Both ends of the locking shaft are pivotally passed through the shaft holes, so as to roll one end of the strap. The cover is pivotally disposed in the pivotal holes and is formed with an engaging rib located correspondingly to the locking shaft and a pair of pushing blocks for facilitating the opening of the cover. After the cover is closed, the locking shaft abuts against one surface of the strap, and a protruding strip of the other surface of the strap is engaged by the engaging rib. The push buttons are disposed in the key holes of the body, and each push button is formed with a pushing block and a restriction block. The push buttons are connected by an elastic sleeve, a positioning block is formed on the elastic sleeve and is provided for fixing the body, and a spring is disposed in the elastic sleeve. When pressing the push buttons, the cover is opened outward.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
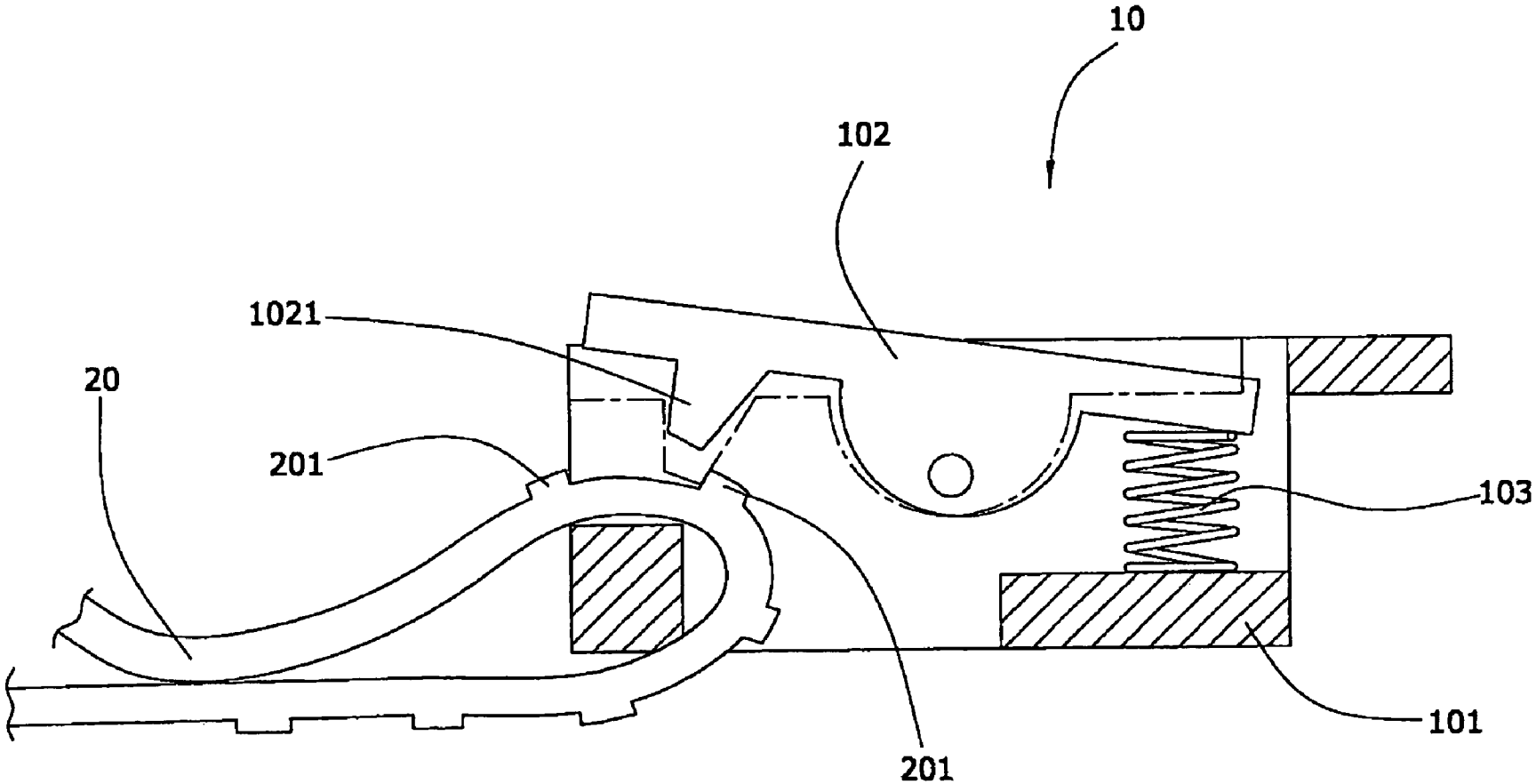
FIG. 1 PRIOR ART
FIG. 1 is an illustrative view showing a conventional adjusting structure for a goggle strap.
Figure 2:
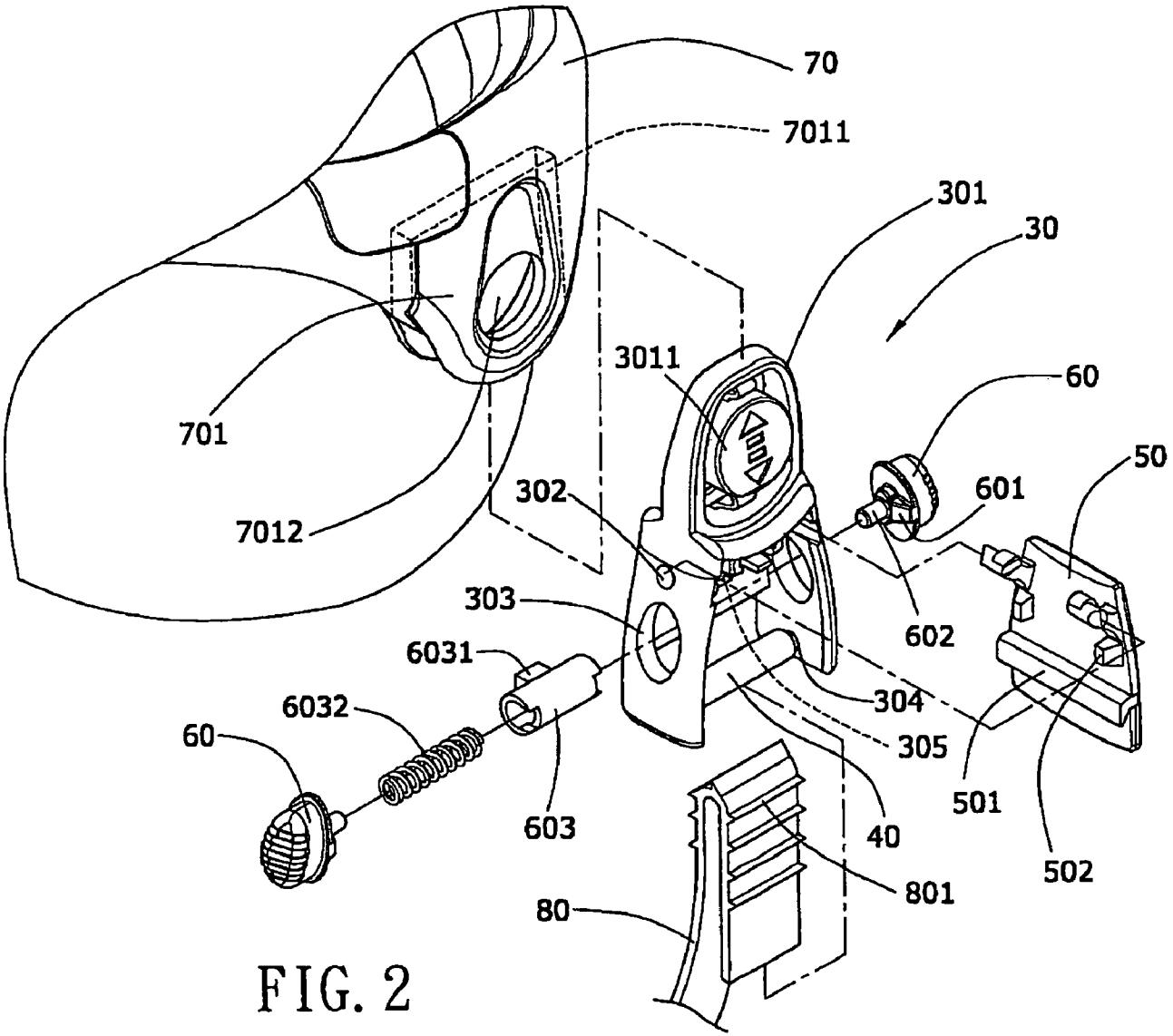
FIG. 2 is an exploded view of an adjusting device for a goggle strap in accordance with a first embodiment of the present invention.
Figure 7:
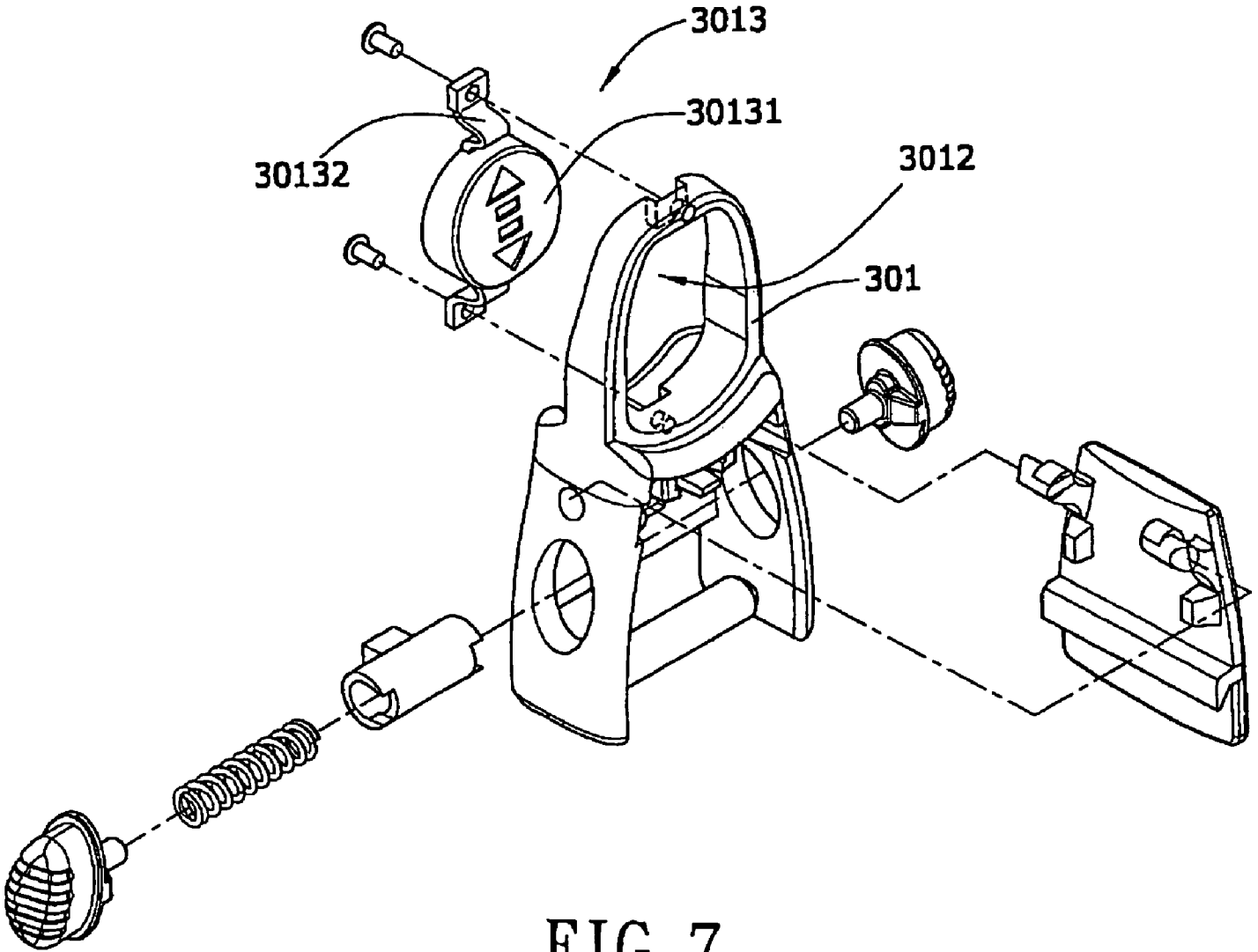
FIG. 7 is an exploded view of a body of the adjusting device in accordance with a second embodiment of the present invention.

Referring to FIG. 2, an exploded view of an adjusting device for a goggle strap in accordance with a first embodiment the present invention is shown, the adjusting device comprises a body 30, a locking shaft 40, a cover 50 and two push buttons 60. The body 30 is formed with a connecting end 301, and the connecting end 301 is disposed with a movable buckle 3011 which is movable within a limited range or is defined with a hole 3012 (referring to FIG. 7, the connecting end 301 of the body 30 of another embodiment of the present invention is shown). An elastic member 3013 is disposed in the hole 3012, and a buckle portion 30131 is defined in a center of the elastic member 3013. Both ends of the buckle portion 30131 are formed with an elastic connecting portion 30132, respectively. At least one of the connecting portions 30132 is fixed in the hole 3012, such that the buckle portion 30131 of the elastic member 3013 is protruded out of the connecting end 301, so as to quickly assemble the connecting end 301 to one of the connecting ends 701 of a goggle body 70. The connecting end 701 is formed with a containing groove 7011, and the containing groove 7011 is defined with a hole 7012. A containing space is defined in the body 30 and is defined with a positioning hole 305. Each side of the body 30 is defined with a pivotal hole 302 for insertion of the cover 50, a key hole 303 for insertion of one of the push buttons 60, and a shaft hole 304 for insertion of the locking shaft 40, respectively Both ends of the locking shaft 40 are pivotally passed through the opposite shaft holes 304 of the body 30, so as to roll one end of a strap 80. The cover 50 is pivotally disposed in the opposite pivotal holes 302 of the body 30, such that the cover 50 is openable. In an inner surface of the cover 50 is formed an engaging rib 501 located correspondingly to the locking shaft 40 and a pair of pushing blocks 502 for facilitating the opening of the cover 50. When the cover 50 is closed, a clearance is formed between the engaging rib 501 and the locking shaft 40, such that one protruding strip 801 of the strap 80 is engaged by the engaging rib 501. The push buttons 60 are disposed in the key holes 303 of the body 30, and each push button 60 is formed with a pushing block 601 and a restriction block 602. After the cover 50 is closed, the pushing blocks 502 of the cover 50 abut against the pushing blocks 601 of the push buttons 60. The push buttons 60 are connected by an elastic sleeve 603, and a positioning block 6031 is formed on the elastic sleeve 603 located correspondingly to the buckle 3011 of the body 30 and is fixed in the positioning hole 305 of the containing space of the body 30. A spring 6032 is disposed in the elastic sleeve 603 and is mounted on the restriction blocks 602 of the push buttons 60. When pressing the push buttons 60, the pushing blocks 601 of the push buttons 60 will push the pushing blocks 502 of the cover 50, such that the cover 50 is opened outward.

Figure 3:
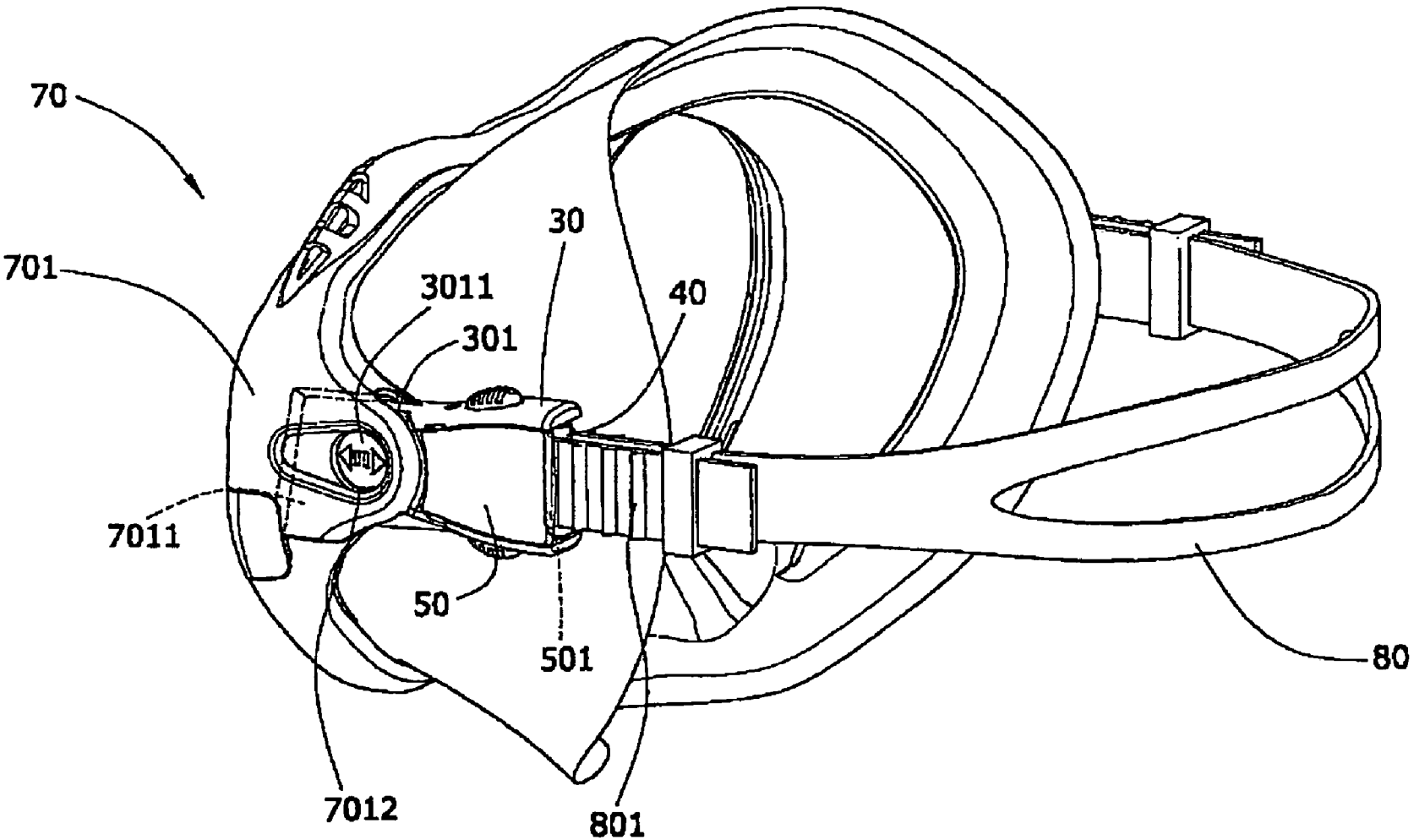
FIG. 3 is an assembly view of a goggle body and the strap in accordance with the present invention.

Referring to FIG. 3, the assembly of the strap and the goggle body is shown, the connecting end 301 of the body 30 is inserted in the containing groove 701 of the connecting end 701, such that the buckle 3011 of the connecting end 301 is engaged in the hole 7012, thus finishing the assembly of the body 30 and the goggle body 70. In addition, one end of the strap 80 is rolled around the locking shaft 40, after the cover 50 is closed, the strap 80 is passed through the clearance between the engaging rib 501 of the cover 50 and the locking shaft 40, and the protruding strip 801 of the strap 80 is engaged by the engaging rib 501. Further, when the goggle is not in use, the buckle 3011 of the connecting end 301 of the body 30 can be pressed to disengage from the hole 7012 of the connecting end 701 of the goggle body 70, such that the body 30 which is combined with the strap 80 can be quickly separated from the goggle body 70, thus facilitating the preservation and cleaning of the components.

Figure 4:
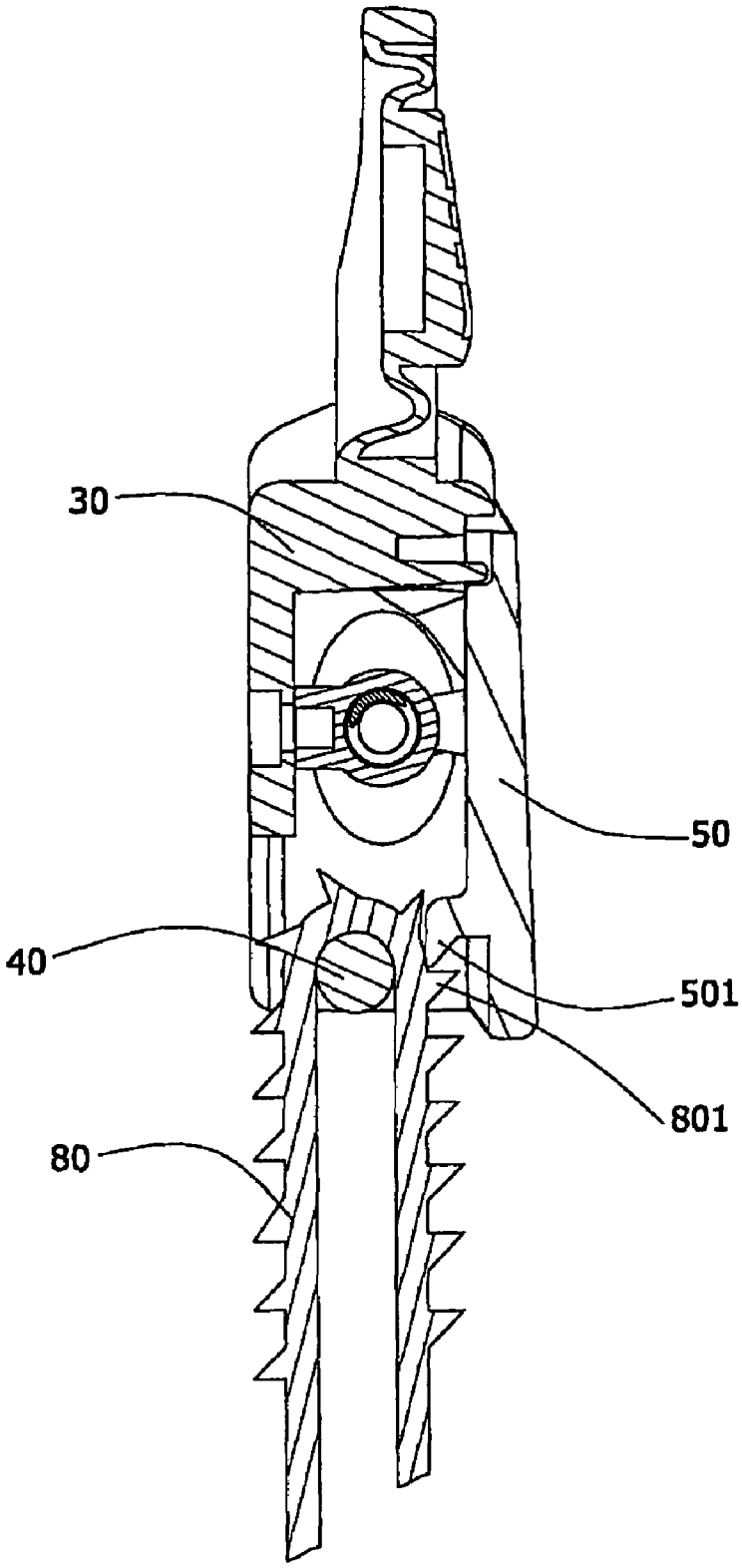
FIG. 4 is a cross sectional view showing the strap being combined with the goggle body in accordance with the present invention.

Referring to FIG. 4, a cross sectional view of the strap combined with the goggle of the present invention is shown, the strap 80 is rolled around the locking shaft 40 passed through the body 30, after the cover 50 is closed, the clearance is formed between the engaging rib 501 and the locking shaft 40. And the locking shaft 40 abuts against the other surface of the strap 80 without any protruding strip 801, such that the protruding strip 801 of the strap 80 is pressed by the locking shaft 40 to move toward the engaging rib 501 and is engaged with the engaging rib 501 of the cover 50, so as to fix the strap 80. On the contrary, when the cover 50 is opened, the protruding strip 801 of the strap 80 is disengaged with the engaging rib 501, so that the length of the strap 80 can be adjusted again.

Figure 5:
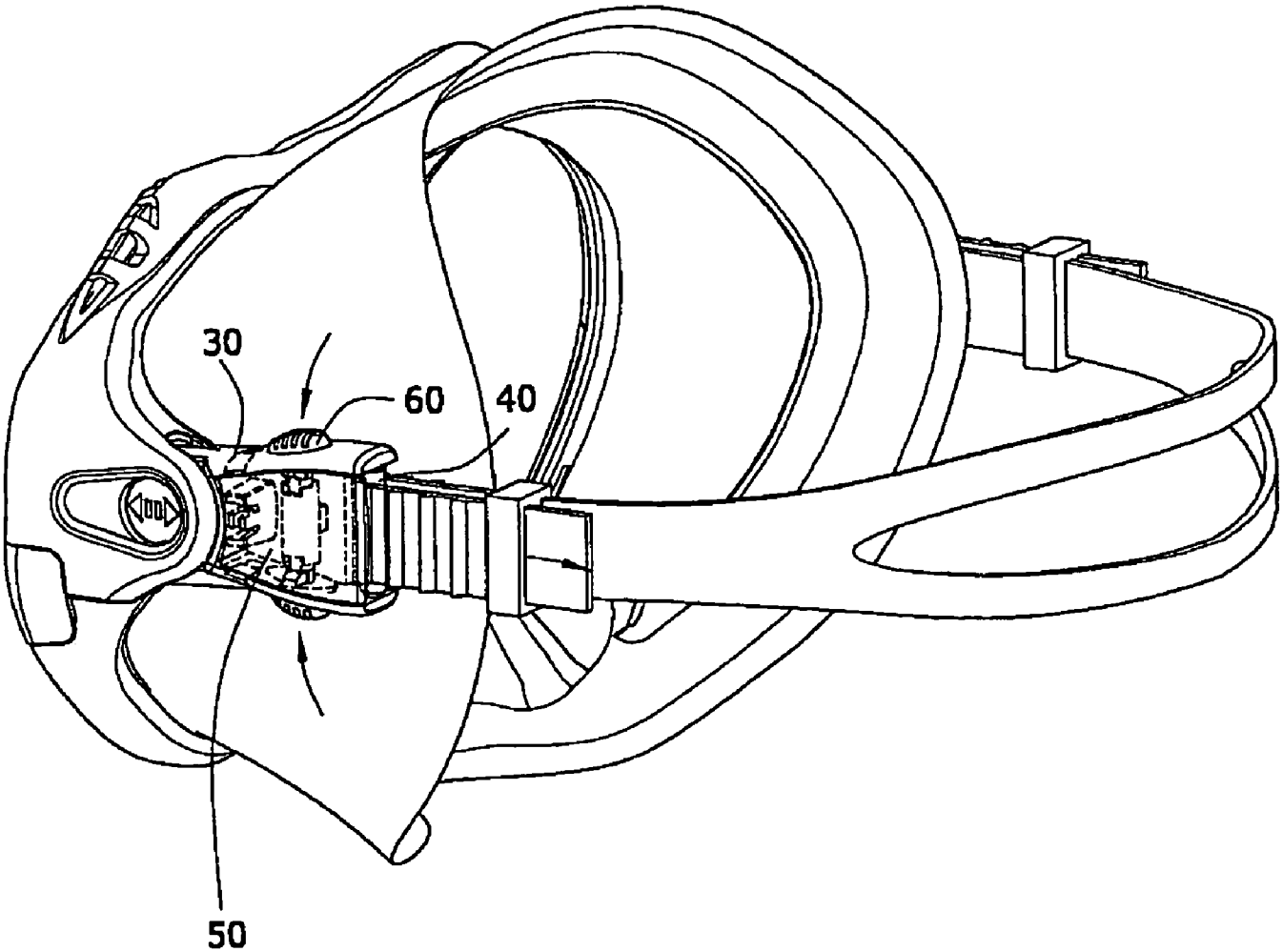
FIG. 5 is an illustrative view showing the adjustment of the length of the strap in accordance with the present invention.
Figure 6:
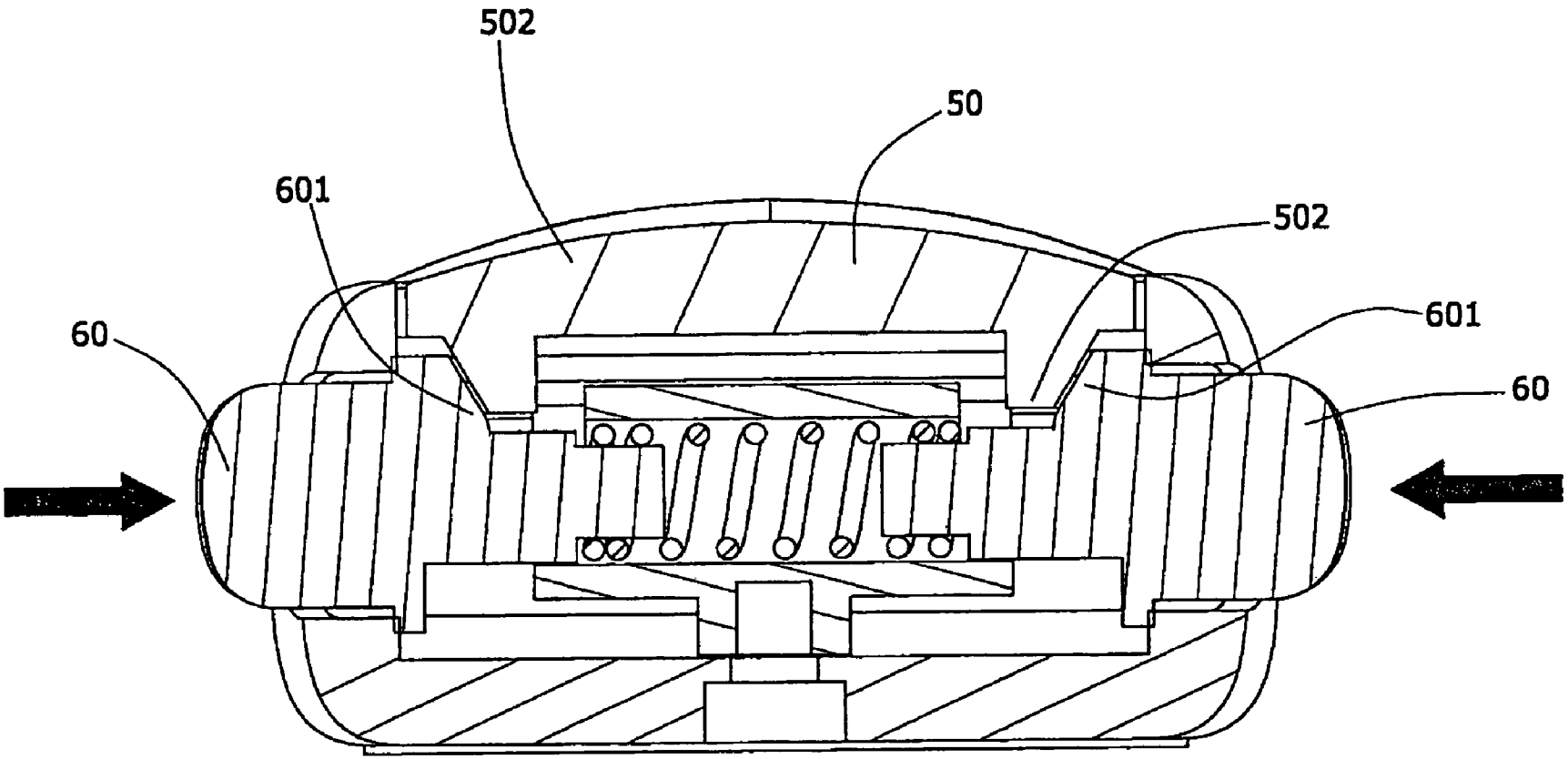
FIG. 6 is an illustrative view showing the operation of two push buttons and the cover in accordance with the present invention.

Referring to FIG. 5, when adjusting the length of the strap 80, the user presses the push buttons 60 disposed at both sides of the body 30, such that an inward clamping force is produced. Further, when the push buttons 60 move inward (referring further to FIG. 6), since the pushing blocks 601 of the push buttons 60 and the pushing blocks 502 of the cover 50 are previously abutted against each other, the pushing blocks 502 of the cover 50 will be pushed by the pushing blocks 601 of the push buttons 60 to move outward, so that the cover 50 is opened. Thereby, the power between the locking shaft 40 and the cover 50 for clamping the strap 80 disappears, such that the length of the strap 80 can be adjusted again. After the length of the strap 80 is adjusted, the cover 50 can be returned to its original position by being turned in reverse direction, thus finishing the adjustment of the strap 80.

To summarize, the present invention utilizes the cover and the locking shaft to clamp the strap and can be quickly assembled to the connecting end of the goggle body. By such arrangements, the length of the strap can be adjusted quickly, and the strap can be assembled to the goggle body easily.

While we have shown and described various embodiments in accordance with the present invention, it should be clear to those skilled in the art that firer embodiments may be made without departing from the scope of the present invention.

What is claimed is:

1. An adjusting device for a goggle strap disposed at both ends of the strap for quick connection to two connecting ends of a goggle body, the adjusting device comprising:

a body formed with a connecting end for assembling to one connecting end of the goggle body, a containing space being formed in the body, and each side of the body being defined with a pivotal hole, a key hole and a shaft hole;

a locking shaft, both ends of the locking shaft being passed through the opposite shaft holes of the body, so as to roll one end of the strap;

a cover pivotally disposed in the pivotal holes of the body and formed with an engaging rib located correspondingly to the locking shaft and a pair of pushing blocks for facilitating the opening of the cover, after the cover is closed, one of a plurality of protruding strips of the strap will be engaged by the engaging rib;

two push buttons disposed in the key holes of the body, each push button being formed with a pushing block and a restriction block, the push buttons being connected by an elastic sleeve, a positioning block being formed on the elastic sleeve and provided for fixing the body, a spring being disposed in the elastic sleeve, and the cover is openable by pressing the push buttons.

2. The adjusting device for a goggle strap as claimed in claim 1, wherein the connecting end of the body includes a movable buckle which is movable within a limited range.

3. The adjusting device for a goggle strap as claimed in claim 1, wherein the connecting end of the body is defined with a hole, an elastic member is disposed in the hole, at least one end of the elastic member is fixed in the hole of the connecting end, such that a buckle portion of the elastic member is engaged in the hole of the connecting end of the body.

4. The adjusting device for a goggle strap as claimed in claim 1, wherein a positioning hole is defined in the containing space.

5. The adjusting device for a goggle strap as claimed in claim 1, wherein the locking shaft abuts against one surface of the strap after the cover is closed, and one of the protruding strips of the strap is engaged by the engaging rib of the cover.

6. The adjusting device for a goggle strap as claimed in claim 1, wherein the pushing blocks of the cover abut against the pushing blocks of the buttons after the cover is closed.

* * * * *